United States Patent [19]

Kelly

[11] Patent Number: 5,003,649

[45] Date of Patent: Apr. 2, 1991

[54] NESTABLE COT AND END CONNECTOR THEREFOR

[75] Inventor: Ray G. Kelly, Kirkwood, Mo.

[73] Assignee: Angeles Nursery Toys, Inc., Pacific, Mo.

[21] Appl. No.: 461,326

[22] Filed: Jan. 5, 1990

[51] Int. Cl.[5] ..... A47C 19/00

[52] U.S. Cl. ..... 5/8; 5/111; 5/288

[58] Field of Search ..... 108/53.3; 5/8, 9, 110, 5/111, 279 B, 282 R, 285, 288, 701

[56] References Cited

U.S. PATENT DOCUMENTS

| | | | |
|---|---|---|---|
| 1,355,486 | 10/1920 | Longenecken | 5/8 X |
| 2,567,619 | 9/1951 | Rosenfeld | 5/285 |
| 2,678,787 | 5/1954 | Averill | 248/120 |
| 2,721,338 | 10/1955 | Resnick | 5/285 |
| 2,871,489 | 2/1959 | Emmert | 5/288 X |
| 2,916,239 | 12/1959 | Stopps | 248/120 |
| 2,924,830 | 2/1960 | DeLong | 5/8 |
| 3,336,060 | 8/1967 | Bradford | 5/8 X |
| 3,400,671 | 9/1968 | Erismann | 108/53 |
| 3,710,405 | 1/1973 | Watts | 5/285 X |
| 4,065,818 | 1/1978 | Farina | 5/288 |
| 4,646,371 | 3/1987 | Nowell | 5/285 X |
| 4,729,136 | 3/1988 | Santo | 5/285 X |
| 4,870,711 | 10/1989 | Felix | 5/282 X |
| 4,958,390 | 9/1990 | Mendenhall | 5/201 |

FOREIGN PATENT DOCUMENTS

| | | | |
|---|---|---|---|
| 83783 | 8/1920 | Austria | 5/8 |
| 210562 | 8/1960 | Austria | 5/8 |

OTHER PUBLICATIONS

Danti-Li-On Cots and More, 1pc. literature, (Wilsonville, Oreg.).

*Primary Examiner*—Eric K. Nicholson
*Attorney, Agent, or Firm*—Paul M. Denk

[57] ABSTRACT

A nestable cot (C1) has a web (3) of material on which an occupant of the cot can lay. The web is attached to a frame (F) which includes a plurality of rods (R1–R4) one of which extends along each side of the web. End connectors (5) are provided for connecting respective ends of adjacent rods to interconnect the rods and complete the frame. Each end connector includes an elongate housing (7) having an opening (25, 27) at each end in which respective ends of adjacent rods are received. The cot is supported in an elevated position off the ground by a pedestal (33) formed intermediate the length of the housing. The pedestal projects inwardly from an inner face (19) of the housing and extends downwardly a distance sufficient to elevate the web of material off the ground. A pad (49) is attachable to the bottom of the pedestal. The cot can be sat upon another cot (C2) with the base (51) of the pad of the upper cot resting upon the upper surface (35) of the pedestal of the lower cot whereby the upper cot nests in the lower cot.

18 Claims, 3 Drawing Sheets

NESTABLE COT AND END CONNECTOR THEREFOR

BACKGROUND OF THE INVENTION

This invention relates to pallets, cots and the like and more particularly, to a nestable cot for use in a children's day care facility.

Many child care or childrens' day care facilities have a routine of activities for the children. For young children, particularly preschoolers, this routine often includes one or more scheduled rest periods. One such period may be scheduled in the morning, for example, and another such period in the afternoon. During this time, the children lie down to rest and to nap. In some facilities, mattresses, rest mats, or pallets are provided for the children to lie on. It is also common to provide cots. Cots have an advantage over rest mats in that they are raised off the floor. But, unlike rest mats, they are not readily rolled up or conveniently stored in place for other activities. Storage space must he provided for them when they are not in use. Since space in day or child care facilities is usually at a premium, it is important that the cots require as little storage space as possible.

There is available upon the market a nestable cot wherein it includes tubing having connectors provided at its corners, but the connectors are fabricated of multiple components, with a series of fastening means provided within each tube insert, and requires the usage of various tools to provide initially for the assembly of the connector, and then its installation to the tubing forming the cot structure. This product is manufactured and marketed by a company named Dandelion Co., of Oregon.

The current type of folding cot available for usage is either the old Army style wooden collapsible cot, but the concern with usage of that type of cot is that when folded, it may have a tendency to pinch the fingers, particularly of young children, when manipulating the same. In addition, there is the bent tubing type of cot, wherein the legs fold outwardly, generally at an angle, and thereby extend beyond the perimeter of the rest surface itself. Hence, this type of a cot is difficult to stack, as when stored.

Most cots are collapsible or can be disassembled. If disassembled after each use, they can be put away without too much trouble and the children using them will have ample activity room available. However, disassembling and reassembling cots once or twice a day is a time consuming activity and chore. It would be easier if the cots were left in their assembled state This can be done if the cots can he safely and interlockingly stacked. Stackable rest mats and cots are known in the art. See, for example, U.S. Pat. Nos. 3,400,671 to Erismann, 2,916,239 to Stopps, and 2,678,787 to Averill. These patents address material handling pallets, and as such, are not compatible with cots such as those used by children. Other cot stacking arrangements are available. One of these, for example, replaces the normal corner connector structure of a cot with a complicated multicomponent corner connector structure. To install one on each of the four corners of a cot is not only time consuming, but requires the use of various hand tools. And, if parts are lost or misplaced, the cots cannot be stacked or only stacked with difficulty. What is needed is a simple arrangement for providing stacking of fully assembled cots. The arrangement should be easy to install without the need of tools, or through usage of a single simple tool, such as a screwdriver, to facilitate assembly, when necessary, and provide easy stackability so that cots can be quickly set-out at the beginning of a rest period and put-away when the rest period is over.

SUMMARY OF THE INVENTION

Among the several objects of the present invention may be noted the provision of a cot; the provision of such a cot having end or corner connectors by which rods comprising a cot frame can be joined; the provision of such connectors to have a pedestal for elevating the cot off the ground; the provision of such connectors to include a shelf upon which corresponding connectors of other cots can rest thereby to allow the cots to nest in one another in a vertical, stackable arrangement; the provision of such connectors to be of a one-piece construction and exhibits inherent safety; the provision of such connectors to be readily assembled on the frame without the use of tools either without the use of tools, or through application of a minimum of simple tools, such as a screwdriver; and, the provision of such a cot which is lightweight, transportable, and readily stacked with other, similar cots so as to require a minimal amount of storage space when the cots are not in use.

The invention, briefly stated, is for a nestable cot comprising a web of material on which an occupant of the cot can lay. The material is attached to a frame which includes a plurality of rods one of which extends along each side of the web. End connectors are used to interconnect the respective ends of adjacent rods to complete the frame. Each end connector has an elongate housing unit with an opening at each end in which respective ends of the adjacent rods are received. A support stand for supporting the cot in an elevated position off the ground includes a pedestal formed intermediate the length of the housing unit and projecting inwardly from the inner face thereof. The pedestal extends downwardly a distance sufficient to elevate the web of material off the ground. The height of the pedestal is greater than the distance between the top of the pedestal and the top of the housing. This allows one cot to be set upon another cot with the base of the pedestal of the upper cot resting upon the upper surface of the pedestal of the lower cot. The upper cot thus nests in the lower cot and the cots are arranged in a vertical, stacked configuration, requiring reduced floor space. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
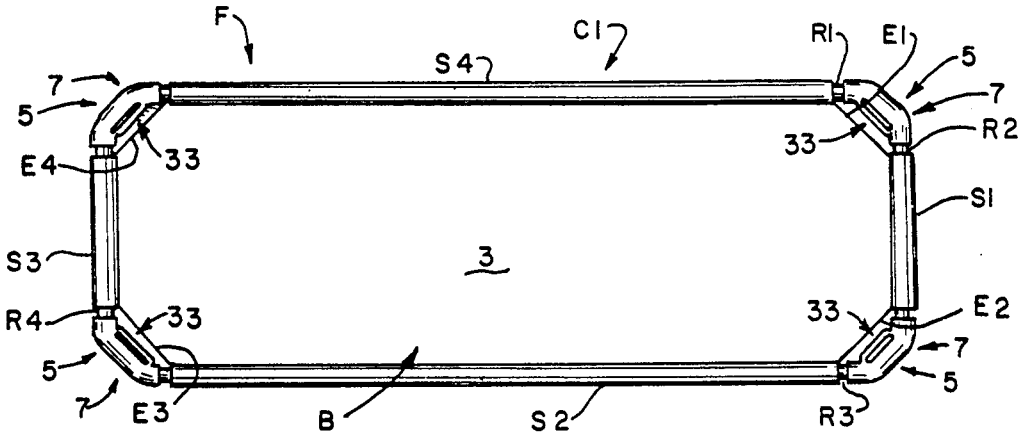
FIG. 1 is a top plan view of a cot of the present invention.

Referring to the drawings, a cot Cl for use in a child care or day care center is shown. The cot comprises a web 3 of a suitable material forming a bed B on which a person such as a child can lay. The web is generally rectangular in shape with the corners each trimmed back to form diagonal edges E1–E4. The material along each side and end of the web is folded back over on itself to form an open selvage with the two layers then sewn together to form respective sleeves S1–S4. It will be understood that the material may he any suitable natural or synthetic material and the sleeves may he formed by fusing or otherwise joining the layers of material together, if the material is a synthetic, rather than by sewing. The material is attached to a frame F which includes longitudinally and laterally extending rods R1–R4. In the alternative, the selvage S1 may connect to its respective rod or R4 under pretensioning principles, whereby the end of the proximate material may be rolled onto the rod R4, and the rod R4 may incorporate an internal spring that continuously turns it in a direction that causes sustained tensioning for the material, and thus maintains the cot material reasonably tight, during all applications and usage. Such a spring means may be akin to the type that is used in the window shade industry, as is known in the art. This may provide an automatic tensioning to the material forming the surface on the cot. The rods are of an appropriate length and diameter so to fit through the sleeves formed on the respective sides and ends of the web. As shown in FIG. 1, rods R1 and R3 extend along the sides of the web and rods R2 and R4 across the ends.

Figure 4:
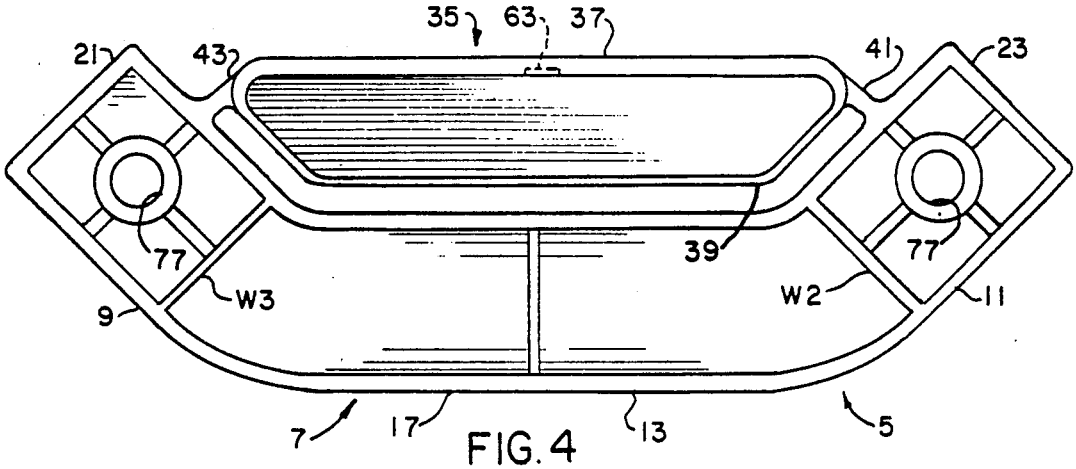
Figure 8:
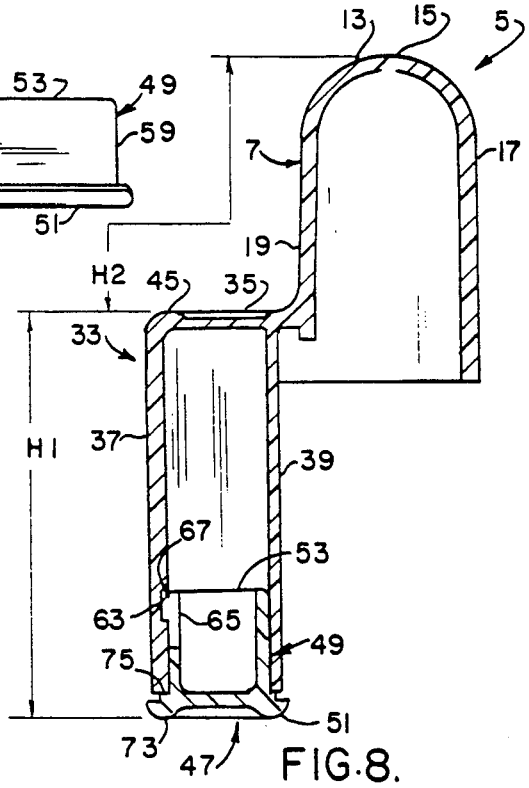
FIG. 8 is a sectional view taken along line 8—8 in FIG. 3.

End connectors indicated generally at 5 are provided for connecting the respective ends of adjacent rods to interconnect them and complete assembly of the cot. Each end connector is identical in appearance so to be interchangeable. The connectors are, for example, of a molded plastic construction and each includes a housing 7 having respective end sections 9 and 11 and an intermediate center section 13. The housing has a rounded top 15, rear wall 17, front wall 19 and end walls 21 and 23. The housing is also of an integral molded construction in which the end sections angle or flare diagonally outwardly from the center section. Thus, the end connector does not present any sharp corner on which a child could be injured if he or she ran into or fell upon it. The interior of the housing is hollow (as shown in FIGS. 4 and 8) with various interior walls, walls W1–W3 for example, being formed during molding, such as polymer molding, of the housing to strengthen it. Each end section of the housing has an opening, such as the openings 25 and 27, in its respective end wall. The openings are sized to accommodate the ends of the respective rods and a cylindrical pocket, 29 and 31 respectively, extend into the interior of the end section from the opening. The length of these pockets is sufficient to insure the end of rods are firmly mounted to the connector and cannot be easily dislodged. Again, this is for protection of the children using the cot.

Figure 3:
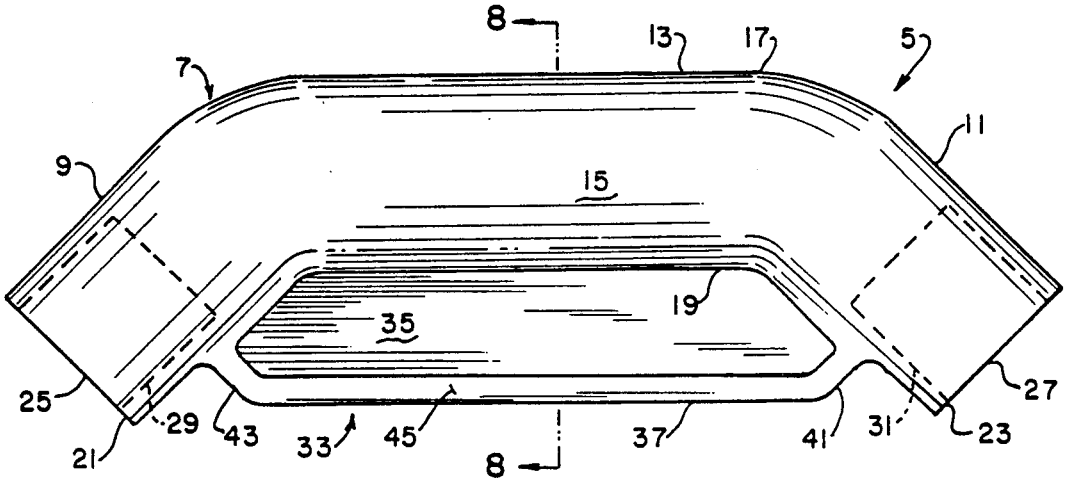
FIGS. 3 and 4 are respective top and bottom plan views of an end connector used on the cot.

The housing next includes a pedestal or stand portion 35. The pedestal is located intermediate the length of the housing and, for example, extends the length of the center section thereof. The pedestal is integrally formed with the housing and projects outwardly from the base portion of the front wall of the housing. It also extends downwardly a distance sufficient to elevate the bed off the ground. The height is such that when someone is recumbent on the bed, the downward stretch in the material caused by their weight will not cause the bed to touch the ground. As shown in FIGS. 3, 4 and 8, the pedestal has an upper or top surface 35, a front wall 37, a rear wall 39, and side walls 41 and 43. The pedestal is generally trapezoidal in plan with the front and rear walls being parallel to each other. Further, the front wall is longer than the rear wall for the end walls to each angle inwardly from front to rear. Referring to FIGS. 4 and 8, internal wall W1 extends downwardly from the top of the housing beyond the base of rear wall 17. The wall has an arcuate shape and extends from one end of the rear wall of the pedestal to the other at a point intermediate the height of the pedestal.

Figure 2:
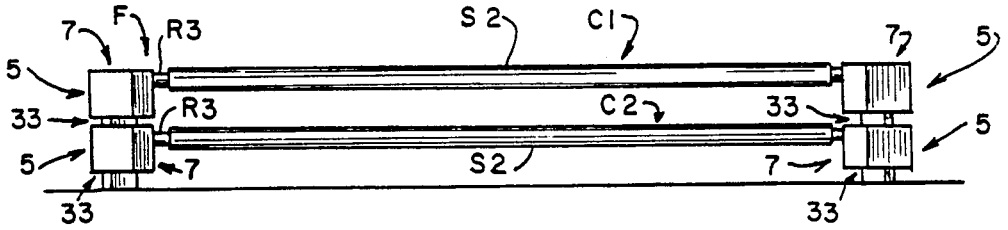
FIG. 2 is a side elevational view of two costs nested together in a vertical, stacked arrangement.
Figure 9:
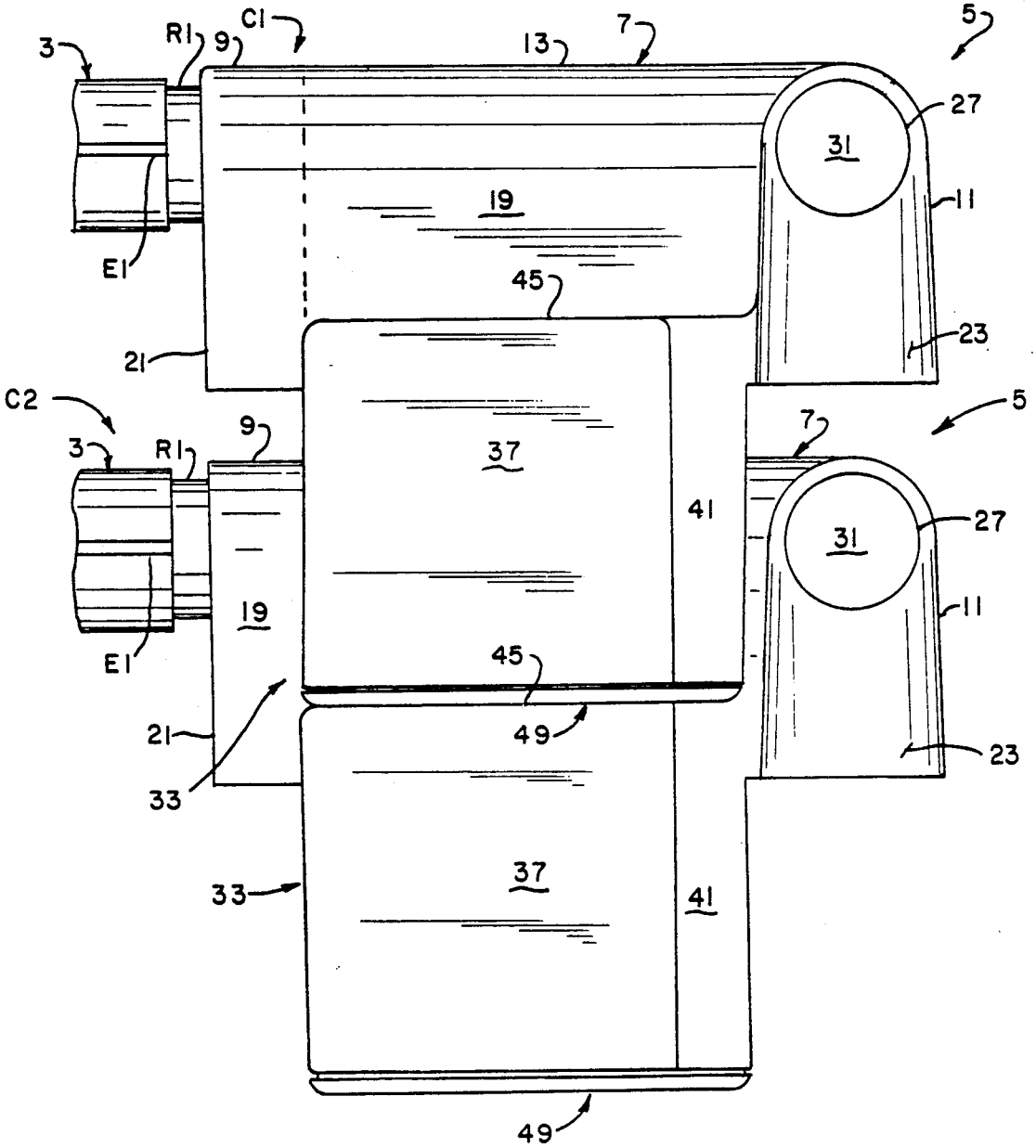
FIG. 9 is an elevational view of two end connectors for separate cots and illustrates how one cot partially nests within another.

The height H1 of pedestal 33 (see FIG. 8) is greater than the height H2 between top surface 35 of the pedestal and top surface 15 of the housing. This means the pedestal of an end connector 5 on one cot can be set upon or be nested with the end connector 5 of another cot. Top surface 35 of the one pedestal then forms a shelf or platform upon which the base of the other pedestal can rest. As shown in FIGS. 2 and 9, cot C1 and a cot C2 are nestable together in a vertical, stacked arrangement. This is done by fitting the pedestal portion of each end connector on cot C1 over the housing portion of the corresponding end connector on cot C2. Since the height of the respective pedestals exceed the distance between their tops and the tops of their associated housings, the pedestals slide down over the front of the housings until they rest atop the pedestal on the end connector below. When they touch, there is ample clearance between the base of the upper end connector and the top of the lower one. The benefit to maintaining clearance between the base of the connector, or the underside of the cot, and the top of the surface of the cot maintained therebelow, is to afford proper ventilation between the cots, as when stacked, and not in use, and in addition, to prevent any pinching to occur to particularly the children, when manipulating the cots to and from a storage condition. It will be understood that while only two cots are shown in a nested, stacked arrangement, additional cots using end connectors 5 could be added to the stack. The materials used in making the cots are lightweight so the cots are easy to lift, move, and stack.

Figure 5:
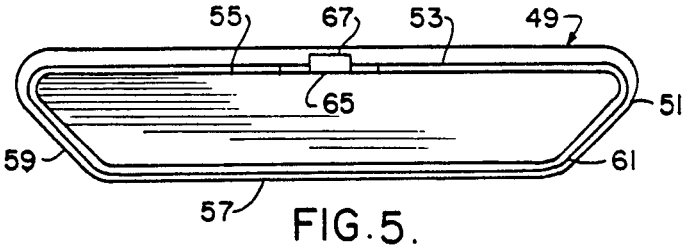
FIG. 5 and 6 are respective top plan and front elevational views of a pad fitting on the bottom of the connector.
Figure 6:
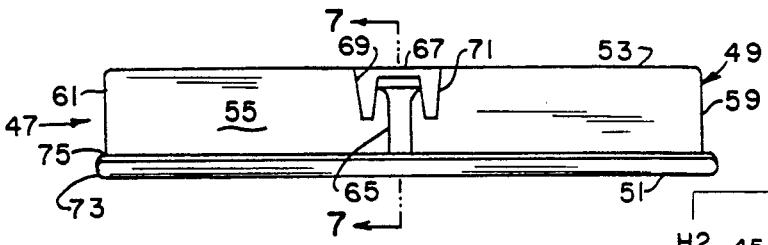
Figure 7:
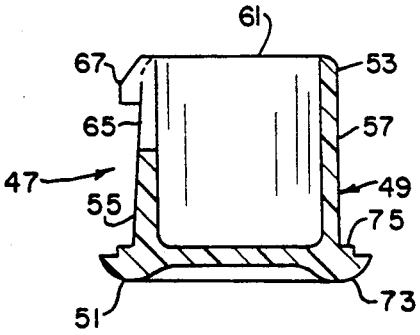
FIG. 7 is a sectional view of the pad taken along line 7—7 in FIG. 6.

Referring to FIGS. 5–7, a pad means 47 includes a pad 49 having an integrally formed base section 51 and a stem 53 extending upwardly from the base section. The pad is typically formed of the same polymer or other material as the rest of the end connector. The stem is trapezoidal in plan and designed to be received in the open bottom of the pedestal. Thus, the outer dimensions of the front wall 55, rear wall 57, and respective end walls 59 and 61 of the stem correspond to the inner dimensions of the corresponding walls of pedestal 33. A notch 63 is formed on the inner face of front wall 37 of the pedestal. A vertically extending finger 65 is formed in front wall 55 of the pad, the finger having an outwardly projecting portion 67 at its upper end receiveable in the notch to interlock the pad and the pedestal. Vertical slots 69 and 71 respectively extend downwardly on either side of the finger, from the top of front wall 55. The slots provide flexibility for the finger during insertion of the stem in the pedestal so it will not break. The bottom of pad base section 53 has a rounded shoulder 73 extending circumferentially therearound. A shoulder 75 also extends around the upper face of the base section outwardly of the walls forming the stem. The bottom of the pedestal abuts this shoulder when the pad is attached to the pedestal.

It can likewise be seen that the end sections 9 and 11, at their under surfaces, have fastener receiving slots, as noted, as at 77, wherein a fastener may he inserted, and fixed in place as by means of a screwdriver, to achieve a securement of each connector to its respective rod R.

It should also he noted that the concept of this invention is generally formed from the styled connector, as seen, and that straight tubing, as at R, is utilized throughout the structure of the shown cot. The usage of straight tubing significantly adds to the economy of the manufacture and assembly of the cot of this invention.

Figure 10:
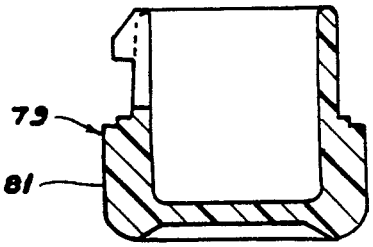
FIG. 10 is a sectional view of a modified pad that is applied to the end connector to furnish it and the cot with greater height.

As previously alluded to, it is desirable to maintain some clearance between the surface of the cots as they are stacked one above the other, as during temporary storage. To achieve such, or to further assure that adequate clearance is provided, particularly in those jurisdictions where regulations may require such, it may be necessary to add further extension to the height of the connector pedestal 33. In referring to FIG. 10, in lieu of the style of pad 49, as shown, a slightly different configured pad 79 may be employed. And, its interfitting within the pedestal, as at 33, will be done similarly to that as the previously identified pad 49, but in this particular instance, it can be seen that the pad is configured having a much longer extension, as at 81, extending downwardly from its connector portion. This extension 81 may be to any length, preferably one to two inches in dimension, so as to greatly heighten the overall length of the pedestal 33, within the cot structure, and thereby provide even greater clearance between cots when stacked, or for the elevation of a cot off of the floor, when arranged into position for usage. In the alternative, an extension similar to that as shown in FIG. 10 may be used, and extend the height of the cot up to approximately 2 inches, or more, with the exception that there will be no integral bottom pad located thereon. Instead of it, the upper part of the extension may look like that as shown in FIG. 10, and then have the extending portion 81 lengthening a few inches the leg of the cot, and the bottom of the extension will have an interior cavity therein, similar to that as shown for the interior downward portion of the pedestal 33, so as to accommodate a standard pad means 47 therein, to provide a closure to the bottom of the extension, and a pad which may rest upon the floor.

While the definition of the invention herein has basically been analyzed from the standpoint of being used in conjunction with the fabrication of cot, it is just as likely that the principle of the connector, as shown and described, could be used in other structures, or particularly items of furniture, such as tables, beds, chairs, cribs, playpens, and related types of constructions.

Variations and modifications to this invention may occur to those skilled in the art upon reviewing the subject matter of this invention. Such variations or modifications, if within the spirit of this invention, are intended to be encompassed within the scope of any claims to patent protection issuing upon this invention. The description of the preferred embodiment provided herein is set forth for illustrative purposes only.

Having thus described the invention, what is claimed and desired to be protected by Letters Patent is:

1. A nestable cot comprising:

a web of material on which an occupant of the cot can lay;

a frame to which the web of material is attached, said frame including a plurality of rods, one of which extends along each side of the web;

end connectors for connection to the respective ends of adjacent rods to interconnect the rods and complete the frame, each end connector including elongate housing means having a top and an opening at each end in which respective end of adjacent rods are received, each housing means having an inner face thereof, support means for supporting the cot in an elevated position off the ground, said support means including a pedestal formed intermediate the length of the housing means and disposed inwardly from the inner face thereof, said pedestal from its top extending downwardly a distance sufficient to elevate the web of material off the ground, the height of the pedestal being greater than the distance between the top of the pedestal and the top of the housing means whereby the end connector means on one cot can fit upon the pedestal of the end connector means of a subjacent cot, the pedestal is hollow and the cot further comprises pad means including a pad having the base and the stem extending upwardly from the base, said stem fitting within the pedestal, the stem being integrally formed with the base and including means for interlocking the pad and the pedestal, and the interlocking means including a flexible latch member formed on one side wall of the stem and having an outwardly projecting finger and the pedestal has a corresponding notch formed an inner wall thereof in which the finger is received.

2. The cot of claim 1 wherein the pedestal and the pad are generally trapezoidal in plan.

3. In a cot comprising a web of material on which an occupant of the cot can lay and a frame to which the web of material is attached, the frame including as plurality of rods one of which extends along each side of the web, the improvement comprising end connectors for connection to the respective ends of the adjacent rods to interconnect the rods and complete the frame, each end connector including elongated housing means having a top and further having an opening at each end in which respective ends of the adjacent rods are received, each housing means having an inner face thereof, support means for supporting the cot in an elevated position off the ground, said support means including a pedestal formed intermediate the length of the housing means and disposed inwardly from the inner face thereof, said pedestal from its top extending downwardly a sufficient distance to elevate the web of material and support the cot off the ground, the height of the pedestal being greater than the distance between the top of the pedestal and the top of the housing means, the top of the pedestal being below the top of the housing so as to form a shelf upon which the lower end of the pedestal on an end connector for a second cot can rest for the second cot to be nested with the first said cot in a vertical stacked arrangement, a pad means attachable to the lower end of each pedestal, the pedestal being hollow and the pad means including a pad having a base and a stem extending upwardly from the base, said stem fitting within the pedestal, and means for interlocking the pad and the pedestal, said interlocking means including a flexible latch member formed on one side wall of the stem and having an outwardly projecting finger, and the pedestal has a corresponding notch formed on an inner wall thereof in which the finger is received.

4. An integral end connector for use on a cot having a web of material on which an occupant of the cot can lay and a frame to which the web of material is attached, the frame including a plurality of rods, one of which extends along each side of the web, the end connector comprising:

elongate housing means having a top and further having an opening at each end in which respective ends of adjacent rods are received, said housing means having an inner face thereof;

support means for supporting the cot in an elevated position off the ground, said support means including a pedestal formed intermediate the length of the housing means and disposed inwardly from the inner face thereof, said pedestal from its top extending downwardly a distance sufficient to elevate the web of material and support the cot off the ground, the height of the pedestal being greater than the distance between the top of the pedestal and the top of the housing means, the top of the pedestal is below the top of the housing means, so as to form a shelf upon which the lower end of the pedestal on an end connector for a second cot can rest for the second cot to be nested with the first said cot in a vertical, stacked arrangement, the pedestal being hollow and the end connector further including pad means attachable to the lower end of the pedestal, the pad means including a pad having a base and a stem extending upwardly from the base, said stem fitting within the pedestal, and means for interlocking the pad and the pedestal, the interlocking means including a flexible latch member formed on one side wall of the stem, and having an outwardly projecting finger, and the pedestal having a notch formed on a corresponding inner wall thereof in which the finger is received.

5. The improvement of claim 4 wherein the housing means has two end sections and a central section all of which are integrally formed with the pedestal, the end sections angling diagonally away from the central section.

6. The improvement of claim 4 wherein the pedestal and the pad are generally trapezoidal in plan.

7. A nestable cot comprising:

a web of material in which an occupant of the cot can lay;

a frame to which the web of material is attached, said frame including a plurality of rods, one of which extends along each side of the web;

end connectors for connection to the respective end of the adjacent rods to interconnect the rods and complete the frame, each end connector including an elongate housing means having a top and further having an opening at each end in which the respective ends of the adjacent rods are received, each housing means having an inner face thereof, and support means for supporting the cot in an elevated position off the ground, said support means including a pedestal formed intermediate the length of the housing means and disposed inwardly from the inner face and integrally with said housing means thereof, said pedestal from its top extending downwardly a distance sufficient to elevate the web of material off the ground, the height of the pedestal being greater than the distance between the top of the pedestal and the top of the housing means whereby the end connector on one cot can fit upon the pedestal of the end connector means on a subjacent cot, the top of each pedestal forming an upper surface, which upper surface is below the top of the housing means, with said pedestal upper surface forming a shelf upon which the lower end of the pedestal on an end connector for a second cot arranged there above can rest and to maintain the second cot in a nested position with said first cot in a vertical and stacked arrangement.

8. The cot of claim 7 wherein the housing means has two end sections and a central section, the end sections angling diagonally away from the central section.

9. The cot of claim 8 wherein the end sections and central section of the housing means and the pedestal are integrally formed.

10. The improvement of claim 7 wherein one of said rods incorporating tensioning means, to provide for continuously biasing the web of material to sustain its tautness during usage of the cot.

11. The cot of claim 7 wherein the pedestal is hollow and the cot further comprises pad means including a pad having a base and a stem extending upwardly from the base, said stem fitting within the pedestal.

12. The cot of claim 11 wherein the stem is integrally formed with the base and includes means for interlocking the pad and the pedestal.

13. In a cot comprising a web of material on which an occupant of the cot can lay and a frame to which the web of material is attached, the frame including a plurality of rods, one of which extends along each side of the web, the improvement comprising end connectors for connection to the respective ends of adjacent rods to interconnect the rods and complete the frame, each end connector including elongate housing means having a top and further having an opening at each end in which the respective end of adjacent rods are received, each housing means having an inner face thereof, and support means for supporting the cot in an elevated position off the ground, said support means including a pedestal formed intermediate the length of the housing means and disposed inwardly from the inner face thereof, said pedestal from its top extending downwardly a distance sufficient to elevate the web of material and support the cot off the ground and the height of the pedestal being greater than the distance between the top of the pedestal and the top of the housing means, the top of the pedestal forming a surface, which is arranged below the top of the housing, so as to form a shelf upon which the lower end of the pedestal on an end connector for a second cot can rest for the second cot to be nested with the first said cot in a vertical stacked arrangement.

14. The improvement of claim 13 further including pad means attachable to the lower end of the pedestal.

15. The improvement of claim 14 wherein the pedestal is hollow and the pad means includes a pad having a base and a stem extending upwardly from the base, said stem fitting within the pedestal, and means for interlocking the pad and the pedestal.

16. The improvement of claim 14 wherein the housing means has two end sections and a central section all of which are integrally formed with the pedestal, the end sections angling diagonally away from the central section.

17. An integral end connector for use on a cot having a web of material on which an occupant of the cot can lay and a frame to which the web of material is attached, the frame including a plurality of rods, one of which extends along each side of the web, the end connector comprising:

elongate housing means having a top and further having an opening at each end in which respective end of the adjacent rods are received, said housing means having an inner face thereof;

support means for supporting the cot in an elevated position off the ground, said support means including a pedestal formed intermediate the length of the housing means and disposed inwardly from the inner face thereof, said pedestal from its top extending downwardly a distance sufficient to elevate the web of material and support the cot off the ground the height of the pedestal being greater than the distance between the top of the pedestal and the top of the housing means, the top of the pedestal forming a surface, the surface of the pedestal being below the top of the housing means so as to form a shelf upon which the lower end of the pedestal on one end connector for a superjacently arranged second cot can rest for the second cot to be maintained in nested condition with the first said cot and in a vertical, stacked arrangement.

18. The cot of claim 11 wherein said pad means having substantial height to elevate the cot from the base or to provide further clearance between cots when stacked.

* * * * *

UNITED STATES PATENT AND TRADEMARK OFFICE

CERTIFICATE OF CORRECTION

PATENT NO. : 5,003,649

DATED : April 2, 1991

INVENTOR(S) : Ray G. Kelly

It is certified that error appears in the above—identified patent and that said Letters Patent is hereby corrected as shown below:

Claim 1, column 6, line 15, change "end", second instance, to ---ends---.

Claim 1, column 6, line 28, change "of" to ---on---.

Claim 1, column 6, line 30, change "the", in both instances, to ---a---.

Claim 3, column 6, line 44, change "as" to ---a---.

Claim 7, column 7, line 58, change "end", second instance, to ---ends---.

Claim 17, column 10, line 9, change "one" to ---an---.

Claim 17, column 9, line 12, change "end" to ---ends---.

Signed and Sealed this

Twenty-second Day of September, 1992

*Attest:*

DOUGLAS B. COMER

*Attesting Officer*

*Acting Commissioner of Patents and Trademarks*